US006022424A

United States Patent [19]

Sellers et al.

[11] Patent Number: 6,022,424

[45] Date of Patent: Feb. 8, 2000

[54] ATOMIZATION METHODS FOR FORMING MAGNET POWDERS

[75] Inventors: Charles H. Sellers; Daniel J. Branagan; Timothy A. Hyde, all of Idaho Falls, Id.

[73] Assignee: Lockheed Martin Idaho Technologies Company, Idaho Falls, Id.

[21] Appl. No.: 08/838,478

[22] Filed: Apr. 7, 1997

Related U.S. Application Data

[60] Provisional application No. 60/015,076, Apr. 9, 1996.

[51] Int. Cl.[7] ..... H01F 1/057

[52] U.S. Cl. ..... 148/101; 75/338; 75/341

[58] Field of Search ..... 148/101, 103; 75/331, 333, 334, 338, 339, 340, 341; 419/12; 252/67.54

[56] References Cited

U.S. PATENT DOCUMENTS

| | | | |
|---|---|---|---|
| 4,402,770 | 9/1983 | Koon | 148/31.57 |
| 4,585,473 | 4/1986 | Narasimhan et al. | 75/5 C |
| 4,597,938 | 7/1986 | Matsuura et al. | 419/23 |
| 4,802,931 | 2/1989 | Croat | 148/302 |
| 4,950,450 | 8/1990 | Chatterjee et al. | 419/10 |
| 4,994,109 | 2/1991 | Willman et al. | 75/338 |
| 5,125,574 | 6/1992 | Anderson et al. | 239/8 |
| 5,242,508 | 9/1993 | McCallum et al. | 148/101 |
| 5,282,904 | 2/1994 | Kim et al. | 148/101 |
| 5,372,629 | 12/1994 | Anderson et al. | 75/332 |
| 5,486,240 | 1/1996 | McCallum et al. | 148/102 |
| 5,811,187 | 9/1998 | Anderson et al. | 428/403 |

OTHER PUBLICATIONS

Branagan, D.J., et. al., "Altering The Cooling Rate Dependence Of Phase Formation During Rapid Solidification In The $Nd_2Fe_{14}B$ System", Journal of Magnetism and Magnetic Materials 146 (1995), pp. 89–102.

Branagan, D.J., et al., "Developing Rare Earth Permanent Magnet Alloys For Gas Atomization", J. Phys. D: Appl. Phys. 29 (1996) pp. 2376–2385.

*Primary Examiner*—John Sheehan

*Attorney, Agent, or Firm*—Wells St John Roberts Gregory & Matkin

[57] ABSTRACT

The invention encompasses methods of utilizing atomization, methods for forming magnet powders, methods for forming magnets, and methods for forming bonded magnets. The invention further encompasses methods for simulating atomization conditions. In one aspect, the invention includes an atomization method for forming a magnet powder comprising: a) forming a melt comprising $R_{2.1}Q_{13.9}B_1$, Z and X, wherein R is a rare earth element; X is an element selected from the group consisting of carbon, nitrogen, oxygen and mixtures thereof; Q is an element selected from the group consisting of Fe, Co and mixtures thereof; and Z is an element selected from the group consisting of Ti, Zr, Hf and mixtures thereof; b) atomizing the melt to form generally spherical alloy powder granules having an internal structure comprising at least one of a substantially amorphous phase or a substantially nanocrystalline phase; and c) heat treating the alloy powder to increase an energy product of the alloy powder; after the heat treatment, the alloy powder comprising an energy product of at least 10 MGOe. In another aspect, the invention includes a magnet comprising R, Q, B, Z and X, wherein R is a rare earth element; X is an element selected from the group consisting of carbon, nitrogen, oxygen and mixtures thereof; Q is an element selected from the group consisting of Fe, Co and mixtures thereof; and Z is an element selected from the group consisting of Ti, Zr, Hf and mixtures thereof; the magnet comprising an internal structure comprising $R_{2.1}Q_{13.9}B_1$.

7 Claims, 13 Drawing Sheets

ATOMIZATION METHODS FOR FORMING MAGNET POWDERS

RELATED PATENT DATA

This application claims priority to provisional application No. 60/015,076, filed on Apr. 9, 1996.

CONTRACTUAL ORIGIN OF THE INVENTION

The United States Government has rights in this invention pursuant to U.S. Department of Energy Contract No. DE-AC07-94ID13223.

TECHNICAL FIELD

The invention pertains to methods of utilizing atomization, methods for forming magnet powders, methods for forming magnets, and methods for forming bonded magnets. The invention further pertains to methods for simulating atomization conditions. Additionally, the invention pertains to magnets.

BACKGROUND OF THE INVENTION

A commercially important type of magnet is an isotropic magnet. Isotropic magnets can comprise numerous alternating north and south poles, creating complex magnetic field patterns. The alternating north and south poles are associated with independent magnetic units (called domains) which are not initially magnetically aligned with each other. Such domains are optimally kept very small to increase the number of independent domains per unit area. As the crystal size, or grain size, of a magnetic material typically defines the maximum domain size of magnets formed from the material, it is advantageous to form the material into extremely fine grain sizes.

Isotropic magnets frequently comprise alloy mixtures of iron (Fe), neodymium (Nd), and boron (B), typically of the general formula $Nd_2Fe_{14}B$. The processing of alloys having a formula of about $Nd_2Fe_{14}B$ is metallurgically complex and requires careful control to obtain a homogeneous distribution of elements necessary for good magnetic properties.

The fine grain size necessary for the single grain/single domain structure of isotropic magnets can only be obtained by rapid solidification of a molten alloy. Presently, two classes of processes are known which may be utilized for rapidly cooling an alloy mixture. The first class encompasses melt-spinning processes. In melt-spinning processes an alloy mixture is flowed onto a surface of a rapidly spinning wheel. Upon contacting the wheel surface, the alloy mixture spreads into a flake-like powder, typically having a size and texture of glitter. The rate of cooling of the mixture can be controlled by controlling the rate of spinning of the wheel. Typically, the wheel will be spun at a rate such that a wheel surface has a tangential speed of about 25 m/sec to achieve a cooling rate on the order of about $10^{6\circ}$ C./sec.

The glitter-like flakes resulting from a melt-spinning process can be crushed into a powder and incorporated into an isotropic magnet. The majority of isotropic magnets are of an MQ1 type made by combining isotropic powders with epoxy and compression molding the epoxy/powder combination into a desired form. Higher strength (mechanical as well as magnetic) magnets can be made by hot-pressing isotropic powders into a fully dense (or MQ2) form. Such hot-pressing typically involves compressing and shaping a magnet powder at temperatures of 725° C. or higher.

A cooling rate on the order of $10^{6\circ}$ C./sec is required to obtain good-quality magnetic properties from $Nd_2Fe_{14}B$.

This is illustrated in the graph of FIG. 1 which shows the relationship between the cooling rate of a melted alloy comprising $Nd_2Fe_{14}B$ and a maximum energy product ($BH_{max}$) of an alloy powder produced from the cooled alloy.

As shown in FIG. 1, if a cooling rate is too slow a low maximum energy product is obtained. A reason for the low maximum energy product is that the alloy mixture separates into different phases during the slow cooling. Thus, the slowly cooled alloy has a microstructure consisting of multiple phases, which is an inferior product. Also, the slow cooling can disadvantageously lead to formation of large crystals, creating unwanted large magnetic domains. The inferior products produced by too-slowly cooling the alloy mixture are referred to as "underquenched".

At another extreme, if the melted alloy is cooled too quickly it forms an amorphous glass which also has an inferior maximum energy product. The inferior products produced by too-quickly cooling the alloy mixture are referred to as "overquenched".

Between the two extremes of overquenching and underquenching a melted alloy is an optimal cooling rate which creates an alloy powder having a peak maximum energy product. A peak maximum energy product is obtained if the melted alloy cools at a rate sufficient to form a nanocrystalline alloy powder.

Generally, it is commercially impractical to obtain a cooling rate precisely capable of forming a powder at its peak maximum energy product. Accordingly, the melted alloy is typically slightly overquenched to form an alloy powder which comprises amorphous and nanocrystalline internal structures. Subsequently, the overquenched material is heat treated. Such heat treatment converts the amorphous structure of the alloy mixture to a microcrystalline phase and thus converts the alloy powder to a form having approximately a peak maximum energy product. The heat treatment typically comprises heating the alloy powder to a temperature of less than or equal to about 650° C. for a time sufficient to improve magnetic properties, such as for example, about four minutes.

Currently, the melt-spinning process is the only commercially available process known which can achieve the necessary rapid cooling rates of $10^{6\circ}$ C./sec to form good quality magnetic powders from $Nd_2Fe_{14}B$. Thus, the melt-spinning process is the only commercially feasible process for producing a powder for an isotropic magnet.

The second class of processes are atomization processes. Atomization processes have potential for forming isotropic magnet powders, but are currently in very limited commercial use. The magnet powders produced by atomization processes differ from those produced by melt-spinning processes in that a magnet powder formed from an atomization process is comprised of generally spherical alloy powder granules, whereas those produced by a melt-spinning process are comprised of flake structures. Atomization processes include water atomization, vacuum atomization, centrifugal atomization, and gas atomization processes.

An example atomization process is a gas atomization process. Gas atomization of rare earth permanent magnets has been investigated for over a decade. Gas atomization potentially offers an advantage over melt-spinning in that a gas atomization apparatus can produce a magnet powder at a rate of tons per hour, whereas a melt-spinning apparatus only produces a magnet powder at a rate of about 100 pounds per hour. A disadvantage of gas atomization processes is that the cooling rate of such processes is typically $10^{5\circ}$ C./sec or less, which results in an underquenched $Nd_2Fe_{14}B$.

A gas atomization apparatus 10 is illustrated in FIG. 2. Apparatus 10 comprises a melting chamber 11, a drop tube 12 beneath melting chamber 11, a powder collection chamber 14, and a gas exhaust 16.

Melting chamber 11 includes an induction melting furnace 18 and a vertically movable stopper rod 20 for controlling a flow of a melt from furnace 18 to a melt atomizing nozzle 22 between furnace 18 and drop tube 12. Atomizing nozzle 22 is supplied with an inert atomizing gas (for example, argon or helium) from a suitable source 24. Source 24 can be a conventional bottle or cylinder of the appropriate gas. Atomizing nozzle 22 preferably atomizes the melt into the form of a spray of generally spherical molten droplets discharged into drop tube 12. The droplets solidify as they fall through discharge tube 12 to form a powder which accumulates in powder collection chamber 14. The powder generally has the consistency of flour.

Melting chamber 11 and drop tube 12 can be connected to an evacuation device (for example, a vacuum pump) 30 via suitable ports 32, conduits 33 and valves 34.

Drop tube 12 is generally filled with a room temperature gas. However, drop tube 12 can also be filled with a liquid gas for more rapid cooling.

A general disadvantage of atomization processes is that the processes typically only cool at a rate of about 100,000° C./sec. Such a cooling rate is too slow to form the slightly overquenched $Nd_2Fe_{14}B$-comprising powder preferred in commercial processes. Thus, although atomization processes, such as, for example, gas atomization, are recognized as having potential advantages over melt-spinning processes, atomization processes are generally not used commercially for forming magnet powders.

Several attempts have been made to improve atomization processes to the point that they are commercially feasible. Among such attempts have been efforts to form alloy mixtures with cooling properties suitable for the relatively low-cooling-rate atomization process. Instead of $Nd_2Fe_{14}B$, alloy mixtures having a significantly higher rare-earth content and a significantly lower iron content are utilized for atomization processes. The use of alloy mixtures having relatively high ratios of rare earth elements to other elements favorably changes the cooling properties of the alloy mixture so that the mixture can form powders having good magnetic properties under the relatively low-cooling-rate conditions of atomization processes. Unfortunately, the high ratios of rare earth elements also create undesired properties of increased corrosion relative to the $Nd_2Fe_{14}B$ utilized in melt-spin processes, and decreased magnetic properties due to a lower volume of the $Nd_2Fe_{14}B$ phase relative to the alloy utilized in melt-spin processes. The increased corrosion is due to the presence of the additional rare earth elements, which oxidize rapidly at room temperature, and which may even spontaneously erupt into flame at room temperature. The rare earth elements tend to corrode particularly rapidly at temperatures above 150° C. The decreased magnetic properties are due to a decrease in the relative amount of iron in the total alloy mixture.

The increased corrosion of the rare earth rich alloy mixtures can become particularly problematic during hot-pressing processes of magnet formation which, as discussed above, typically involve heating a magnet powder to temperatures of 725° C. or higher. Another drawback of the rare earth rich alloy mixtures relative to the $Nd_2Fe_{14}B$ alloys utilized in melt-spinning processes is that the decreased magnetic properties of the rare earth rich alloy mixtures can be worsened during bonded magnet formation as the alloy is diluted with epoxy. For these reasons magnet powders comprising the rare earth rich alloy mixtures utilized in atomization processes are less preferred for use in magnet forming processes then are magnet powders comprising the $Nd_2Fe_{14}B$ alloy mixes utilized by melt-spinning processes. Accordingly, commercial processes are melt-spinning processes, even though, as discussed above, there would be significant advantages in production capacity if an atomization process, such as, for example, a gas atomization process, were commercialized.

Recently, it has been found that the addition of titanium and carbon to an alloy mixture of $Nd_2Fe_{14}B$ will alter the cooling properties of the alloy mixture. Methods for utilizing titanium and carbon to alter the cooling properties of an $Nd_2Fe_{14}B$ alloy mixture are described in U.S. Pat. No. 5,486,240 to McCallum, et al., which issued on Jan. 23, 1996, and which is incorporated herein by reference. McCallum, et al. applied the methodology of titanium and carbon incorporation toward melt-spinning processes. It would be desirable to develop new alloy mixtures for adjusting the cooling rate of atomization processes.

An additional disadvantage of atomization processes can be that they are difficult and expensive to run at even a lab-scale. Accordingly, it would be desirable to develop methods for testing atomization processes which do not require running atomization processes at a lab-scale.

BRIEF DESCRIPTION OF THE DRAWINGS

Preferred embodiments of the invention are described below with reference to the following accompanying drawings.

FIG. 6 illustrates a microstructural analysis of an alloy composition produced by a method of the present invention, illustrating x-ray diffraction scans of several powder range sizes.

FIG. 7 illustrates a graph showing particle-sized dependence of energy products of as-atomized and heat-treated powders of a rare earth rich alloy composition in accordance with the prior art.

FIG. 8 illustrates a graph showing particle-sized dependence of energy products of as-atomized and heat-treated powders of an alloy powder of the present invention.

FIG. 9 illustrates a graph showing de-magnetization curves of a prior art alloy powder cooled by melt-spinning (1), a prior art alloy powder cooled by inert gas atomization (2), and an alloy powder of the present invention cooled by inert gas atomization (3).

FIG. 10 illustrates a graph showing de-magnetization curves of an alloy powder of the present invention (1), and a bonded magnet made from such alloy powder of the present invention using 5 wt. % epoxy (2).

DETAILED DESCRIPTION OF THE PREFERRED EMBODIMENTS

Figure 1:
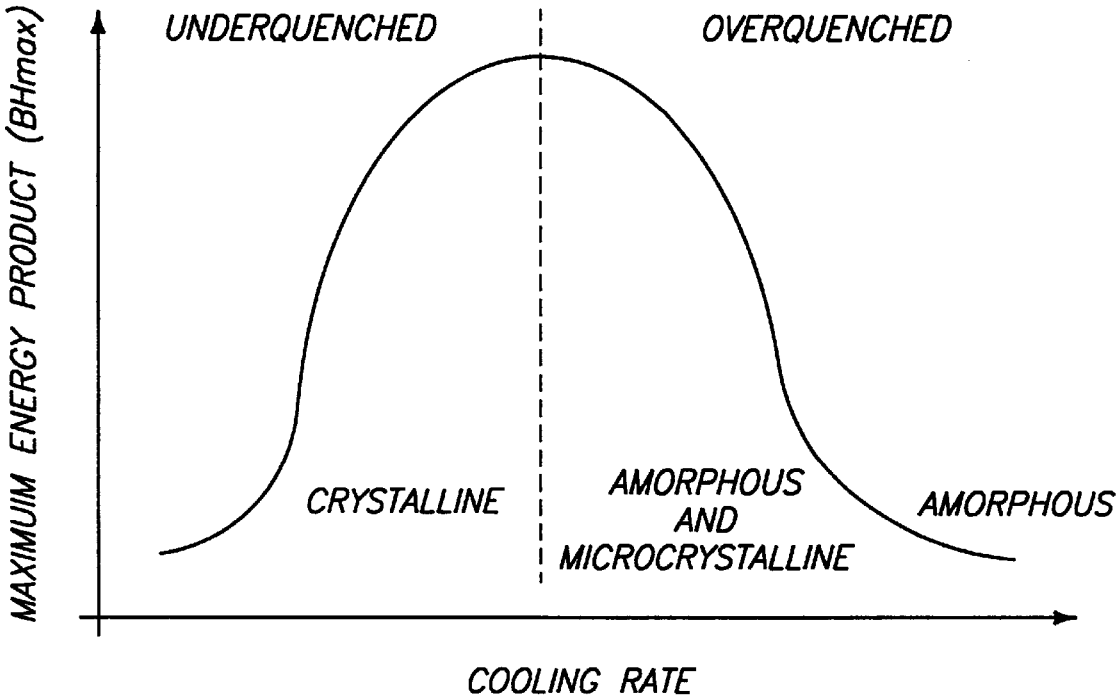
FIG 1 PRIOR ART
FIG. 1 is a graph of a curve illustrating a relationship between cooling rate and maximum energy product ($BH_{max}$) for a prior art alloy comprising $Nd_2Fe_{14}B$.

This disclosure of the invention is submitted in furtherance of the constitutional purposes of the U.S. Patent Laws "to promote the progress of science and useful arts" (Article 1, Section 8).

In one aspect, the invention encompasses an atomization method for forming a magnet powder comprising the following steps:

forming a melt comprising $R_{2.1}Q_{13.9}B_1$, Z and X, wherein R is a rare earth element; X is an element selected from the group consisting of carbon, nitrogen, oxygen and mixtures thereof; Q is an element selected from the group consisting of Fe, Co and mixtures thereof; and Z is an element selected from the group consisting of Ti, Zr, Hf and mixtures thereof;

atomizing the melt, the atomizing including forming an atomized melt and cooling the atomized melt at a rate of less than or equal to about 100,000° C./second to form generally spherical alloy powder granules having an internal structure comprising at least one of a substantially amorphous phase or a substantially nanocrystalline phase; and heat treating the alloy powder to increase an energy product of the alloy powder; after the heat treatment, the alloy powder comprising an energy product of at least about 10 MGOe.

In another aspect, the invention encompasses a method for forming a magnet powder comprising the following steps:

forming a melt comprising Nd, Q, B, Z and X, wherein X is an element selected from the group consisting of carbon, nitrogen, oxygen and mixtures thereof; Q is an element selected from the group consisting of Fe, Co and mixtures thereof; and Z is an element selected from the group consisting of Ti, Zr, Hf and mixtures thereof;

atomizing the melt, the atomizing including forming an atomized melt and cooling the atomized melt at a rate of less than or equal to about 100,000° C./second to form alloy powder granules having an internal structure comprising at least one of a substantially amorphous phase or a substantially nanocrystalline phase, the internal structure comprising a compound of the general formula $Nd_pQ_qB_r$ and having a weight percentage of elements selected from the group consisting of iron, cobalt, and mixtures thereof of at least 60%; and heat treating the alloy powder to increase an energy product of the alloy powder; after the heat treatment, the alloy powder comprising an energy product of at least about 10 MGOe.

In yet another aspect, the invention encompasses a magnet comprising R, Q, B, Z and X, wherein R is a rare earth element; X is an element selected from the group consisting of carbon, nitrogen, oxygen and mixtures thereof; Q is an element selected from the group consisting of Fe, Co and mixtures thereof; and Z is an element selected from the group consisting of Ti, Zr, Hf and mixtures thereof; the magnet comprising an internal structure comprising $R_{2.1}Q_{13.9}B_1$.

In yet another aspect, the invention encompasses a method for simulating gas atomization conditions comprising the following steps:

forming a prototype melt;

cooling the prototype melt by ejecting the prototype melt onto a chill wheel having a surface tangential wheel speed of about 10 m/s to form a prototype cooled melt having physical properties, the physical properties approximating physical properties that would have been obtained had the prototype melt been cooled by gas atomization conditions; and analyzing the physical properties of the prototype cooled melt and estimating therefrom physical properties that would have been obtained had the prototype melt been cooled by a gas atomization process.

Figure 2:
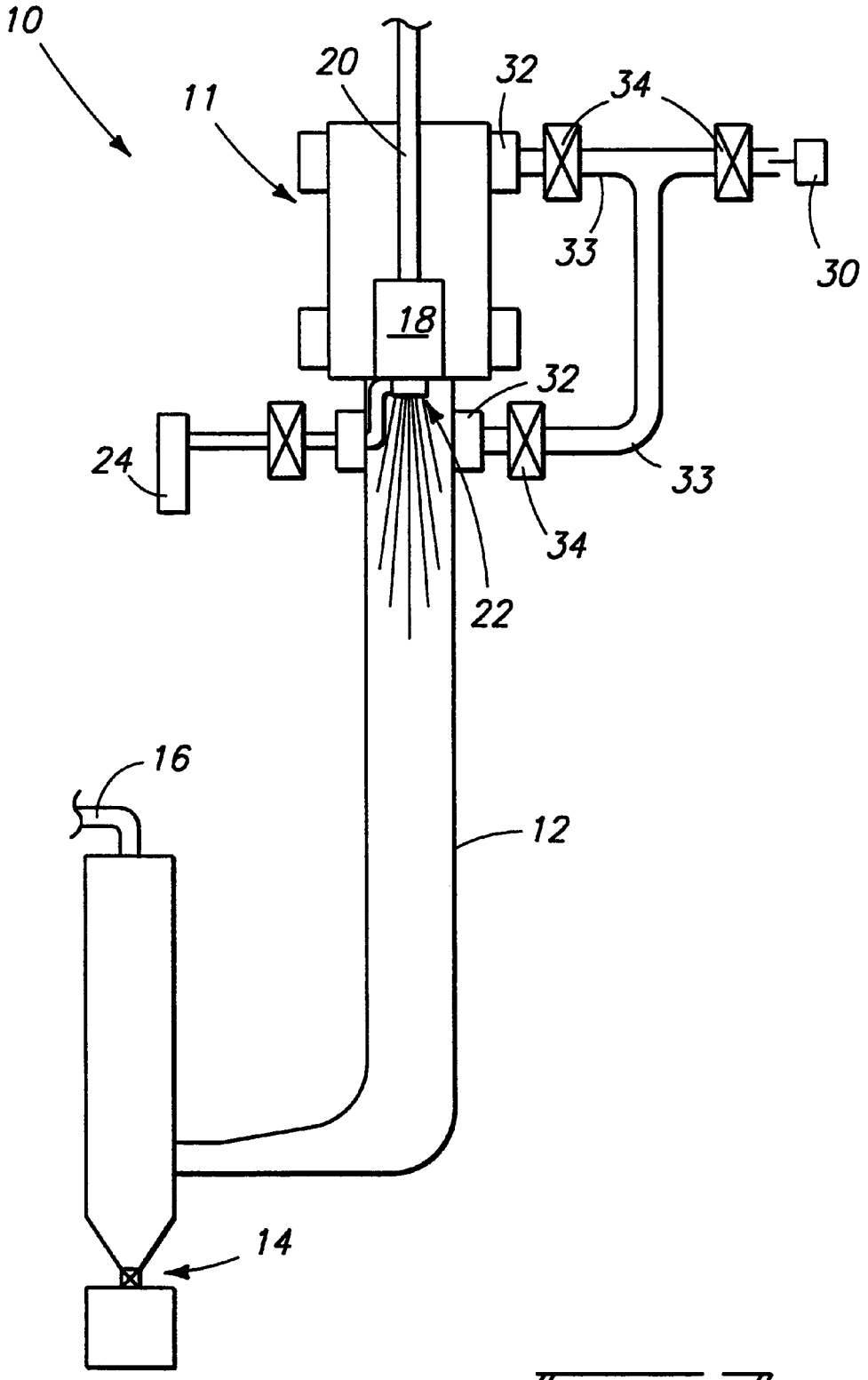
FIG 2 PRIOR ART
FIG. 2 is a schematic cross-sectional view of a prior art inert gas atomization apparatus.

In a preferred method of the present invention, an alloy melt comprising the general formula R, Q, B, Z and X is utilized in an atomization apparatus, such as, for example, apparatus 10 of FIG. 2, to form a magnet powder. "R" is a rare earth element, such as, for example, Y, La, Ce, Pr, Nd, Sm, Er, Gd, Tb, Dy, Ho, Tm, Yb, and Lu, and is preferably Nd. "Q" is an element selected from the group consisting of iron, cobalt and mixtures thereof, and is preferably iron. "Z" is an element selected from the group consisting of Ti, Hf, Zr and mixtures thereof, and is preferably Ti. "X" is an element selected from the group consisting of carbon, nitrogen, oxygen and mixtures thereof, and is preferably carbon. Preferably, Z and X are provided in substantially stoichiometric amounts relative to one another to provide ZX. The weight percentage of Z and X in the melt will preferably be from about 0.1% to about 15%, more preferably from about 2% to about 6%, and most preferably about 3%.

The alloy melt preferably comprises Nd, Q and B in a relative stoichiometry of $Nd_pQ_qB_r$, with the weight percentage of Q being at least 60% and preferably at least 69%. More preferably, the weight percentage of Q will be greater than 70%. Most preferably, $Nd_pQ_qB_r$ will be $Nd_{2.1}Fe_{13.9}B_1$. The stoichiometry of $Nd_{2.1}Fe_{13.9}B_1$ provides significant advantages over prior compositions that had been used in atomization, in that the ratio of iron to the total mix is higher than that which had previously been utilized. Compounds having the general formula $Nd_{2.1}Q_{13.9}B_1$ may also provide similar advantages over prior compositions.

A magnet powder forming operation of the present invention is described with reference to apparatus 10 of FIG. 2. The above-described alloy melt is formed within melting chamber 11 and gas atomized at nozzle 22 to form an atomized melt comprising substantially spherical droplets. Although the prior art apparatuses utilized an inert gas, such as argon, to atomize the melt, it is recognized that other gases can also be utilized for atomizing melts. Such other gases could be particularly applicable for atomizing melts, like the melt of the present invention, which can resist corrosion. Thus, the present invention encompasses any gas atomization process, including inert gas atomization processes.

The droplets formed by the atomization are cooled at a rate of less than or equal to about 100,000° C./sec as they descend through drop tube 12 and become generally spherical alloy powder granules by the time they reach the bottom of drop tube 12. The alloy powder granules are collected within powder container 14.

The generally spherical alloy powder granules will typically be from about 1 micrometer to about 300 micrometers in diameter. The powder granules will comprise an internal structure having a compound of the general formula $Nd_pQ_qB_r$, wherein p, q and r are determined by the initial stoichiometry of the Nd, Q and B originally placed in the melt. Accordingly, if the Nd, Q and B are originally in the melt in a stoichiometry of $Nd_{2.1}Q_{13.9}B_1$, the internal structure of the alloy powder granules will also be $Nd_{2.1}Q_{13.9}B_1$. The Z and X of the original melt do not get incorporated into the internal structure discussed above, but rather form a separate phase around such structure.

Figure 3:
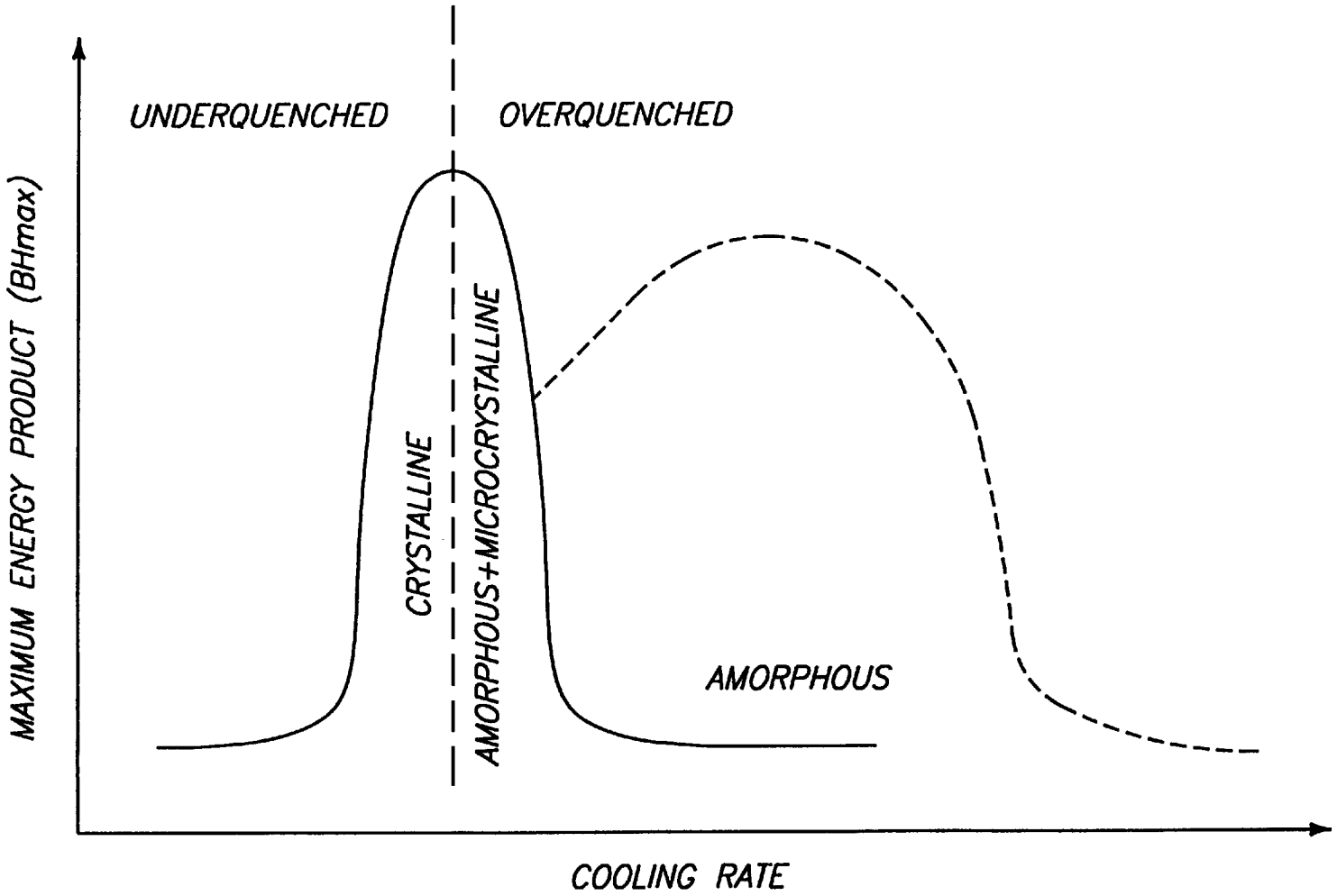
FIG. 3 is a graph of a curve illustrating a relationship between cooling rate and maximum energy product ($BH_{max}$) for an alloy of $Nd_2Fe_{14}B$ modified with TiC (solid line) overlaying the curve of FIG. 1 (dashed line).

Referring to FIG. 3, an advantage of incorporating titanium and carbon into an alloy mixture is illustrated. Specifically, FIG. 3 illustrates two curves, a dashed curve corresponding to the curve of FIG. 1, and a solid curve illustrating how the maximum energy product varies with cooling rate for an alloy containing about 3% titanium carbide. As can be seen in FIG. 3, the entire cooling curve shifts so that the optimum magnetic properties of the alloy occur at significantly lower cooling rates after the alloy is modified with titanium and carbon. The mechanism for this is thought to be that the titanium and carbon form a titanium carbide which disrupts nucleation and crystal growth. Thus, the titanium and carbon cause smaller crystals to be grown at slower cooling rates than would occur in the absence of titanium and carbon. Also, by disrupting crystal growth, the titanium carbide precludes iron from simply crystallizing out of the solution as pure iron, a problem which had previously been encountered with the lower cooling rates of atomization processes. Although FIG. 3 illustrates the effect of titanium and carbon on magnetic properties, it is thought that titanium and nitrogen, or titanium and oxygen, will likely cause similar effects. It is also thought that other transition elements, such as, for example Hf or Zr, may be substituted for Ti.

In preferred aspects of the invention, an alloy melt is cooled at a rate which slightly overquenches the melt. Thus, the alloy powder particles formed by such preferred process comprise a mixture of a substantially amorphous phase and a substantially microcrystalline, or more preferably, a substantially nanocrystalline phase. Subsequently, the alloy powder can be heat treated to cause the amorphous portion of the powder to transform into a microcrystalline, or more preferably, nanocrystalline portion. It has been found that a suitable heat treatment for the alloy powder of present invention comprises a substantially higher temperature than prior art heat treatments. Specifically, a suitable heat treatment for the alloy powder of present invention comprises exposure of the alloy powder to a temperature of from about 800° C. to about 850° C. for a time of about 10 minutes. After the heat treatment, the alloy powder will preferably comprise an energy product of at least 7 megaGauss-Oersted (MGOe), and more preferably will comprise an energy product of at least 10 MGOe.

The method of the present invention advantageously enables an energy product of about 10 MGOe to be obtained from an atomization process utilizing an alloy comprising at least 69% iron. Previous gas atomization processes utilized alloys having a significantly higher rare earth content, and hence a lower iron content, to achieve energy products of about 8 MGOe. As discussed above in the background section, the high rare earth content of previous alloy mixtures utilized in atomization processes were disadvantageous.

Once an alloy powder is formed and heat treated, it may be formed into a magnet by any of a number of methods which will be recognized by persons of ordinary skill in the art, such as for example, hot pressing, die upsetting, extrusion or centering, etc. For example, the alloy powder may be mixed with an epoxy and pressed into a magnet shape. As another example, the alloy powder may be hot-pressed at a temperature of at least 725° C. and formed into a magnet shape. Preferably, if the alloy powder is hot-pressed it will be hot pressed at a temperature of at least 900° C. A preferred atomization-produced alloy powder of the present invention will maintain an energy product of at least 10 MGOe after being formed into a magnet shape.

An advantage of the present invention over the prior art is that the alloy powder granules produced by atomization processes of the present invention can be incorporated into a magnet without first crushing the powder granules. Previously, powder granules, whether produced by melt-spinning or atomization processes, generally had to be crushed before incorporation into a magnet to obtain either proper size or suitably homogeneous magnetic properties from the granules.

Once the alloy powder is formed into a desired magnet shape, a magnetic field may be induced within the magnet shape by placing the magnet shape within a strong magnetic field. The induction of a magnetic field within the magnet shape completes formation of an isotropic magnet from the alloy powder produced by the atomization process.

The processes described above produce magnets comprising the general formula R, Q, B, Z and X, wherein R is a rare earth element, and is preferably Nd; X is an element selected from the group consisting of carbon, nitrogen, oxygen and mixtures thereof, and is preferably carbon; Q is an element selected from the group consisting of Fe, Co and mixtures thereof, and is preferably Fe; and Z is an element selected from the group consisting of Ti, Zr, Hf and mixtures thereof, and is preferably Ti. Preferably, the magnets comprise Ti and X in substantially stoichiometric amounts relative to one another in the form of TiX. Further, the magnets preferably comprise an internal structure of $Nd_{2.1}Fe_{13.9}B_1$.

Figure 4A:
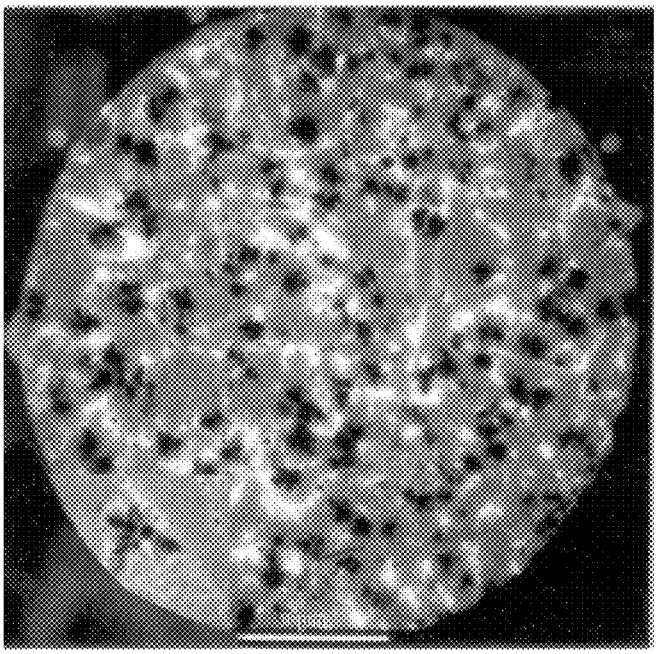
FIG. 4 illustrates scanning electron microscope images of He gas atomized Fe—Nd—B powder cross-sections for (a) a commercial melt-spun alloy composition, (b) a rare earth rich alloy composition, and (c) an alloy composition produced by a method of the present invention.
Figure 4B:
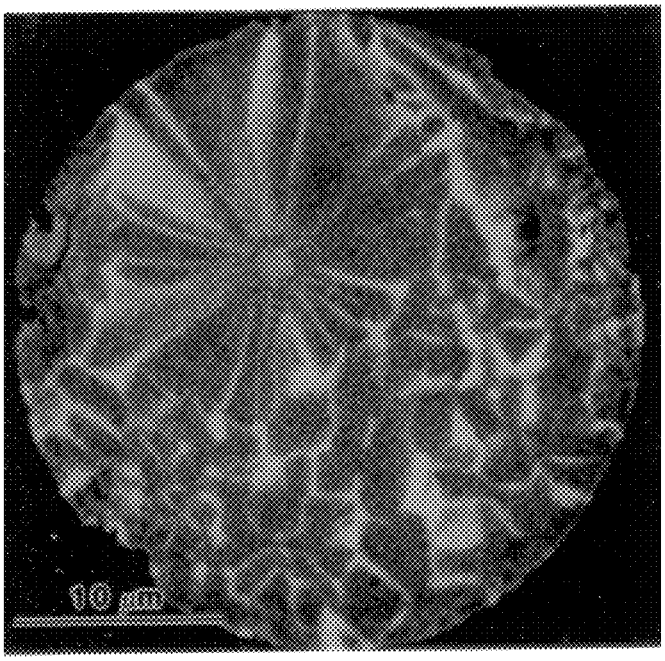
Figure 4C:
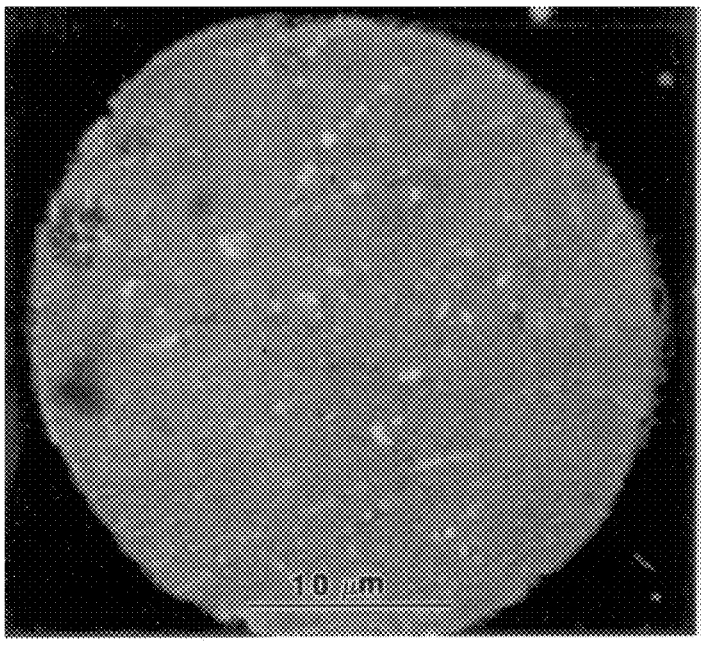

Advantages of the atomization method of the present invention over prior art atomization methods are described below with reference to FIGS. 4–12. Referring to FIG. 4, scanning electron microscope images are illustrated of He gas-atomized Fe-Nd-B powder cross-sections for (4*a*) a commercial melt-spinning alloy composition cooled by gas atomization, (4*b*) a rare earth rich alloy composition cooled by an inert gas atomization method, and (4*c*) an alloy of the present invention cooled by an inert gas atomization method. The commercial alloy composition (4*a*) comprised 68.9% Fe, 30.1% Nd and 1.03% B, by weight. The rare earth-rich composition (4*b*) comprised 63.9% Fe, 31.9% Nd, 3.1% Dy, and 1.13% B, by weight. The alloy of the present invention (4*c*) comprised 67% Fe, 27% Nd, 2.2% Dy, 1.9% Ti, 0.7% C, and 1.17% B, by weight.

Comparing the images of FIG. 4, the rare earth-rich alloy composition (4*b*) and the commercial melt-spinning alloy composition (4*a*) comprise large internal grains of material, whereas the alloy composition of the present invention (4*c*) comprises smaller grain sizes.

Figure 5A:
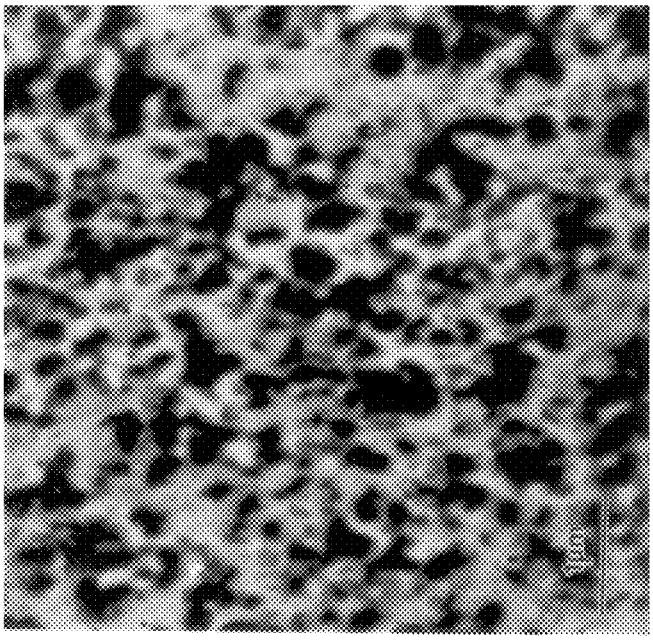
FIG. 5 illustrates magnetic force microscope images of (a) a commercial melt-spun alloy composition, (b) a rare earth rich alloy composition, and (c) an alloy composition produced by a method of the present invention.
Figure 5B:
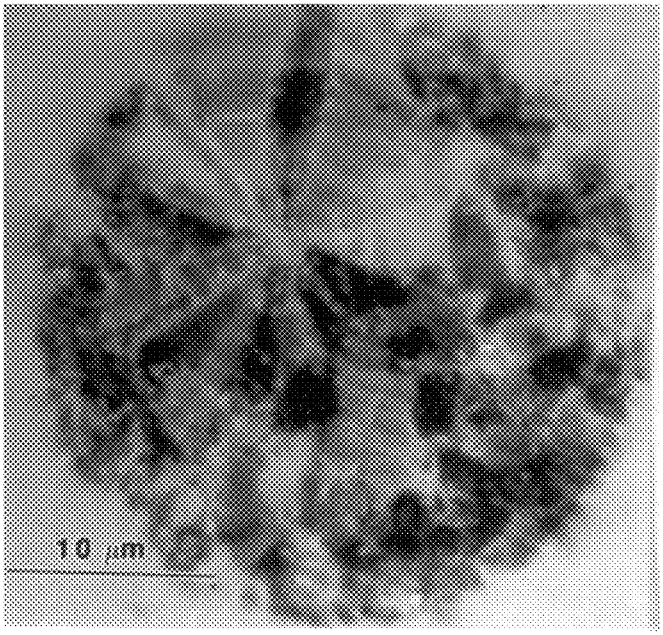
Figure 5C:
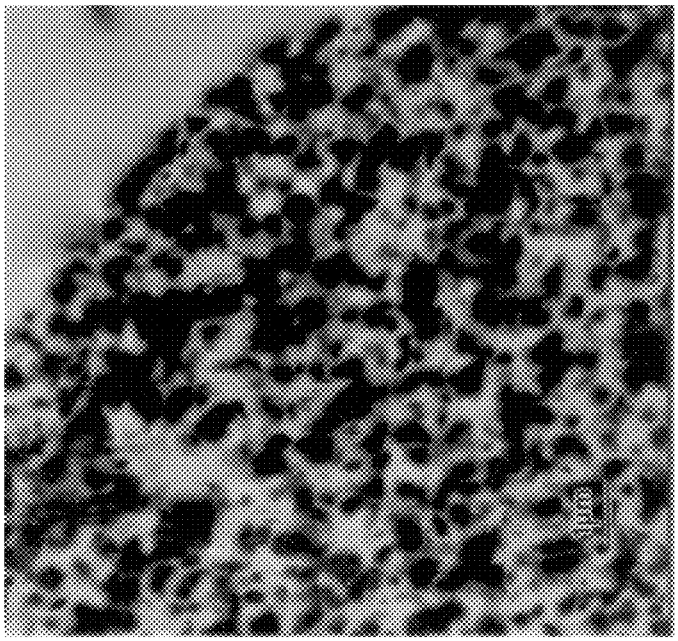

FIG. 5 illustrates magnetic force microscope images of powder cross-sections of (5*a*) a commercial alloy composition cooled by melt-spinning, (5*b*) a rare earth rich alloy composition cooled by an inert gas atomization method, and (5*c*) an alloy of the present invention cooled by an inert gas atomization method. The commercial alloy (5*a*) comprised 68.9% Fe, 30.1% Nd and 1.03% B, by weight. The rare earth-rich composition (5*b*) comprised 63.9% Fe, 31.9% Nd, 3.1% Dy, and 1.13% B, by weight. The alloy of the present invention (5*c*) comprised 67% Fe, 27% Nd, 2.2% Dy, 1.9% Ti, 0.7% C, and 1.17% B, by weight.

FIG. 5, like FIG. 4, indicates that the alloy powder particle of the present invention (5*c*) comprises much smaller domain sizes than does the rare earth-rich alloy powder particle (5*b*). Thus, a magnet powder produced by a gas atomization method of the present invention has a smaller domain size and a more uniform domain structure relative to the rare earth-rich magnet powders produced by prior art gas atomization processes. In fact, the inert-gas-atomized alloy powder particle of the present invention (5*c*) looks quite similar to the particle produced by a commercial melt-spun process (5*a*).

Referring to FIG. 6, x-ray diffraction scans of several powder ranges obtained from an alloy powder of the present invention are illustrated. The alloy powder was formed by cooling an alloy mixture comprising 67% Fe, 27% Nd, 2.2% Dy, 1.9% Ti, 0.7% C, and 1.17% B, by weight, with an inert gas atomization process. The X-ray diffraction scans indicate the presence of a significant amount of an amorphous fraction within the alloy powders. The fact that there is a significant amorphous fraction indicates that the powders were solidified into an overquenched condition, even though the powders were obtained from a gas atomization process, and even though the powders contained a significant amount of iron and were not rare-earth enriched. This indicates a significant improvement over the prior art.

Referring to FIGS. 7 and 8, properties of a prior art gas-atomized powder (FIG. 7) are compared with properties of a gas-atomized powder of the present invention (FIG. 8). The prior art gas-atomized powder comprised 63.9% Fe, 31.9% Nd, 3.1% Dy, and 1.13% B, by weight, and the gas-atomized powder of the present invention comprised 67% Fe, 27% Nd, 2.2% Dy, 1.9% Ti, 0.7% C, and 1.17% B, by weight.

Although both gas-atomized powders exhibit a dramatic dependence of magnetic properties on particle size (in other words, on cooling rate), the particle size dependence of the maximum energy product, as well as the heat treatment response of the powders, is significantly different for the prior art powder (shown in FIG. 7) relative to the powder of the present invention (shown in FIG. 8). Specifically, the rare earth-rich alloy (FIG. 7) shows an improvement in hard magnetic properties as the particle size decreases (in other words, as the cooling rate increases), indicating that these materials are generally underquenched. In contrast, the alloy of the present invention (FIG. 8) exhibits the opposite behavior and is generally overquenched.

Referring to FIG. 8, the alloy powder of the present invention has an as-atomized energy product which is low for the smallest particles, increases with increasing particle size, and then decreases for the largest particles. This is consistent with production of completely amorphous powders in the finer size fractions, particles with amorphous plus nanocrystalline structures in the mid-sized fractions, and particles with coarse, inhomogeneous structures in the largest-sized fractions. Since powders in the largest size range account for only a small weight fraction of an atomization process, the bulk of the particles in the alloy powder of the present invention are in an overquenched condition. The overquenched powder can be crystallized by heat treatment to yield optimal magnetic properties.

Further comparison of the properties of the powder of the present invention (FIG. 8) with the properties of the powder of the prior art (FIG. 7) indicates that the powder of the present invention can actually end up with a higher maximum energy product than the prior art powder. Specifically, the powder of the present invention, after heat treatment, has an energy product in excess of 10 MGOe, whereas the prior art powder only attains a maximum energy product of less than about 9 MGOe, typically about 8 MGOe. It is thought that the higher iron content of the alloy of the present invention enables the alloy to attain maximum energy products in excess of those attained by prior art inert-gas-atomization-generated powders. The high maximum energy product of the powder of the present invention is comparable to energy products attained by commercial melt-spun ribbon processes.

A higher heat treatment temperature is preferably utilized to obtain optimum magnetic properties from the alloy powder of the present invention than the temperatures of the prior art heat treatment utilized for conventional alloys (either melt-spun or atomized) which is discussed above in the Background section. Specifically, a heat treatment temperature for treating the alloy powder of the present invention is preferably at least about 750° C., and more preferably from about 800° C. to about 850° C. Also the heat treatment temperature is preferably maintained for about 10 minutes. Interestingly, the magnetic properties of the alloy powders of the present invention were found to be less sensitive to heat treatment temperature than are conventional alloy powders. This can offer advantages for magnet manufacturing processes. Melt-spun ribbons disadvantageously typically have only a narrow temperature range over which they can be heated due to grain growth problems.

Referring to FIG. 9, de-magnetization curves are compared for (1) an alloy powder comprising 68.9% Fe, 30.1% Nd and 1.03% B, by weight, which has cooled by melt-spinning and heat treated at 650° C. for 10 minutes; (2) a rare earth rich alloy powder comprising 63.9% Fe, 31.9% Nd, 3.1% Dy, and 1.13% B, by weight, which has cooled by inert gas atomization and heat treated at 650° C. for 10 minutes; and (3) an alloy powder of the present invention comprising 67% Fe, 27% Nd, 2.2% Dy, 1.9% Ti, 0.7% C, and 1.17% B, by weight, which has cooled by inert gas atomization and heat treated at 800° C. for 10 minutes.

Two parameters are significant on the curves of FIG. 9. The first significant parameter is the coercivity (the x-intercept of the curves), which is the applied magnetic field required to completely reverse alignment of the magnetic domains. The second significant parameter is the remnant magnetization (the y-intercept of the curves), which is the magnetic field strength remaining in the magnet after all external fields are removed. The maximum energy product is determined by a combination of both parameters, with remnant magnetization being particularly important for obtaining the best magnet performance. Note that while the alloy of the present invention (curve 3) has a lower coercivity than the melt-spun ribbon (curve 1), the remnant magnetization is comparable. Thus, the alloy of the present invention comprises an energy product approaching that of commercial melt-spun products. Notice also that the prior art gas-atomized alloy (curve 2) has properties significantly worse than those of both the melt-spun alloy (curve 1) and the gas-atomized alloy of the present invention (curve 3).

Referring next to FIG. 10, de-magnetization curves are compared for (1) an alloy powder of the present invention comprising 67% Fe, 27% Nd, 2.2% Dy, 1.9% Ti, 0.7% C, and 1.17% B, by weight, which has cooled by inert gas atomization and been heat treated at 800° C. for 10 minutes; and (2) the alloy powder of curve 1 after incorporation into a bonded magnet. The bonded magnet was formed using 5 wt. % epoxy and standard curing conditions which comprised submersing the powder particles in a polymeric binder, followed by warm pressing.

Comparing the curves of FIG. 10, it is noted that the shape of the demagnetization curve for the bonded magnet (curve 2) is essentially the same as that for the powder (curve 1). Moreover, the coercivity remains unchanged as the powder is incorporated into a bonded magnet. Some remnant magnetization is, however, lost after the powder is incorporated into a bonded magnet. This is an expected effect due to the decreased density arising from the lower volume fraction of magnetic material within the bonded magnet relative to the powder.

The data graphed in FIG. 10 shows that the alloy of the present invention can be utilized in epoxy-bonded magnets with little decrease in the coercivity of the material.

Figure 11:
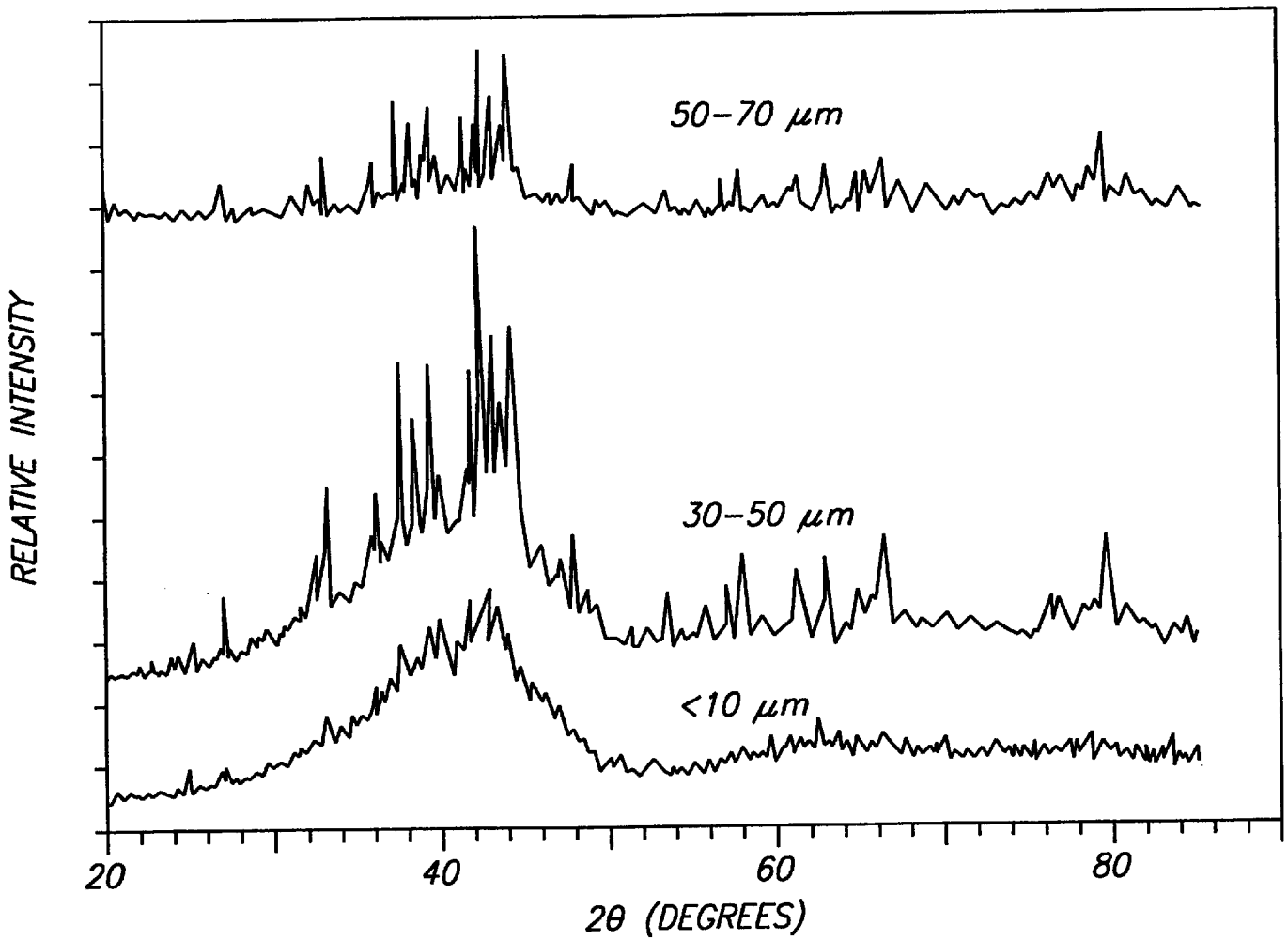
FIG. 11 illustrates a graph of percent weight change versus time of alloy powders held in flowing air at 225° C. for varying lengths of time. The alloy powders are (1) an alloy powder of the present invention, without heat-treatment; (2) an alloy powder of the present invention after heat-treatment; (3) a prior art alloy powder formed by inert gas atomization, without heat-treatment; and (4) a prior art alloy powder formed by inert gas atomization, after heat-treatment.
Figure 11:
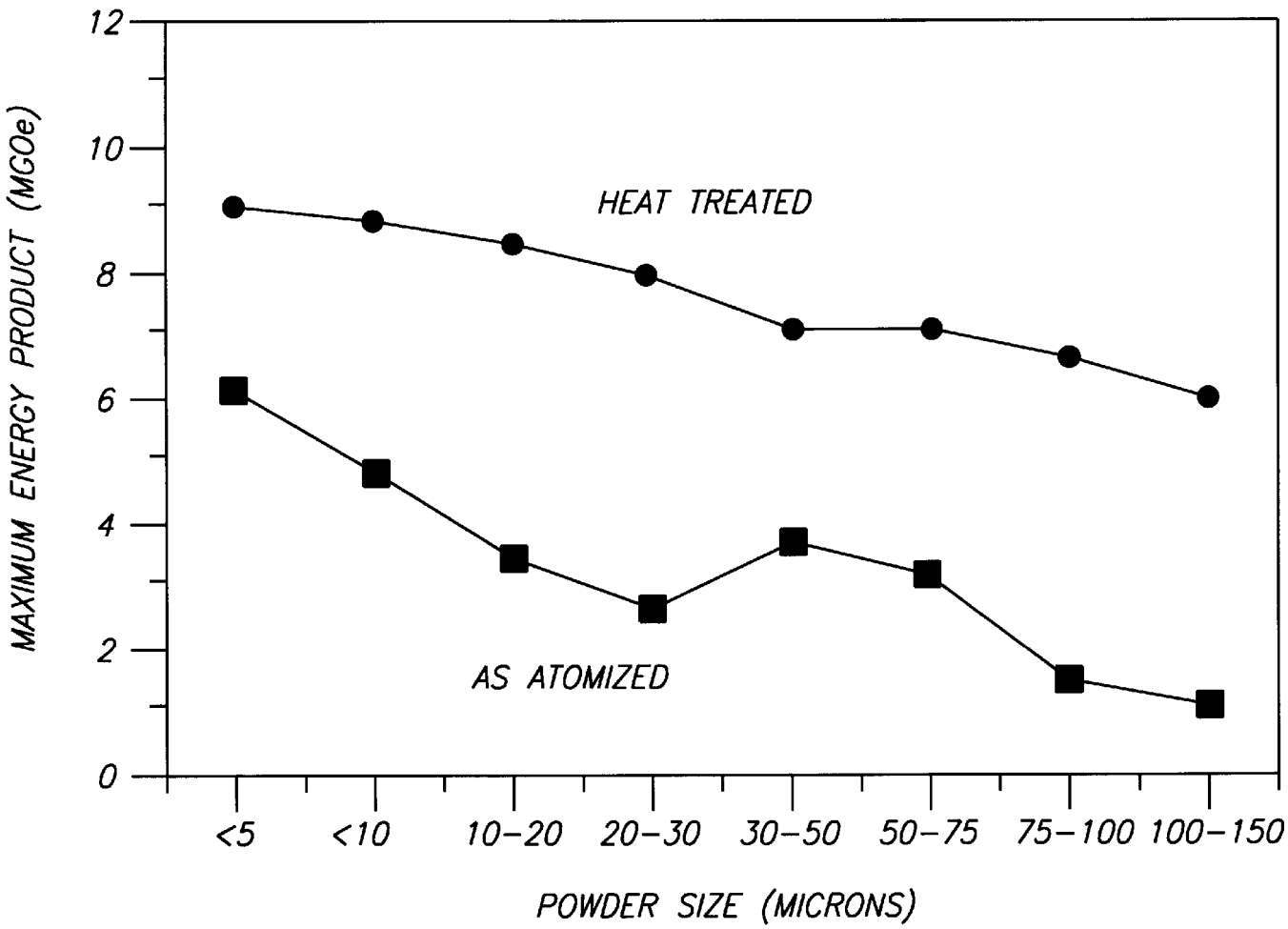
FIG. 11 PRIOR ART
Figure 11:
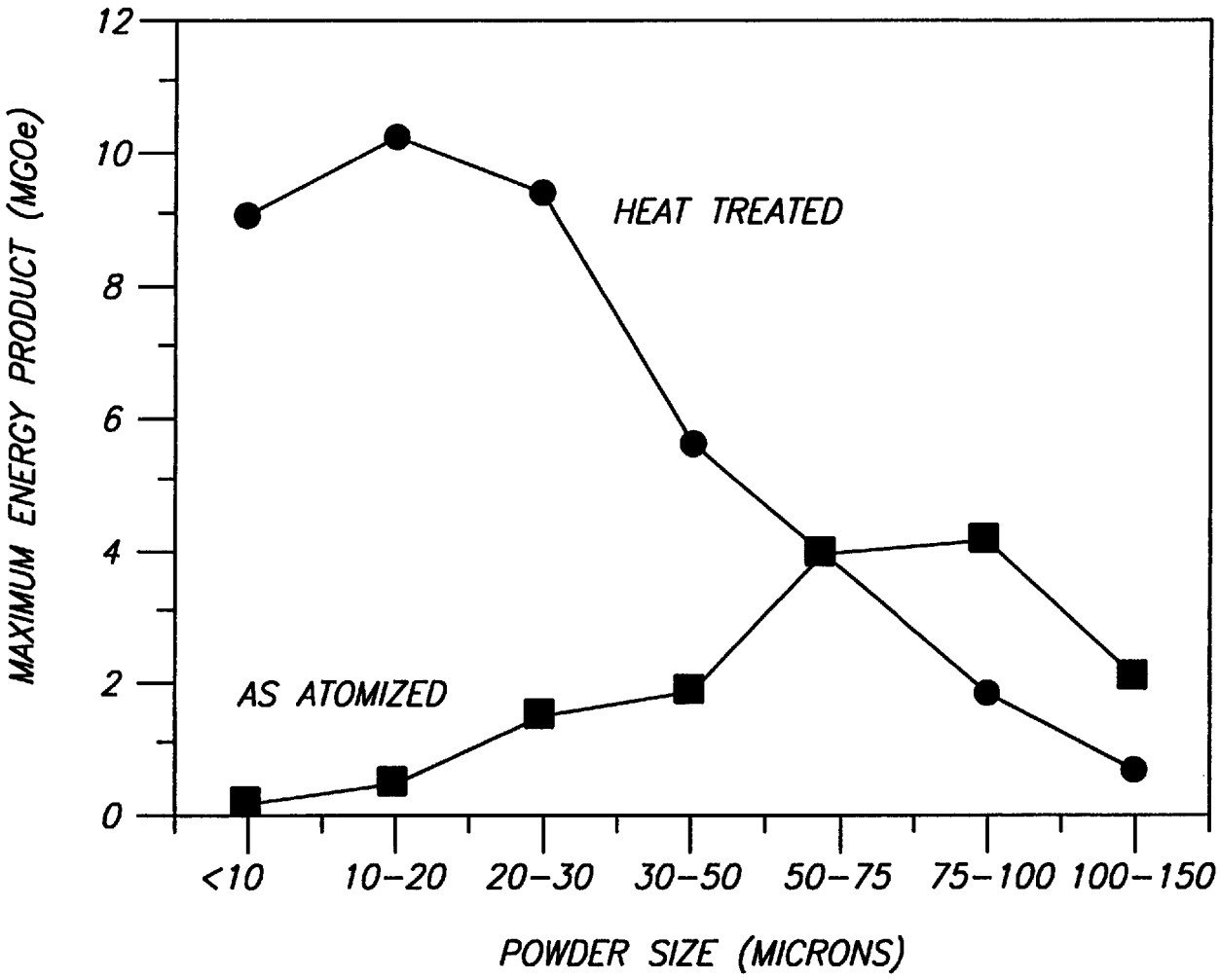
Figure 11:
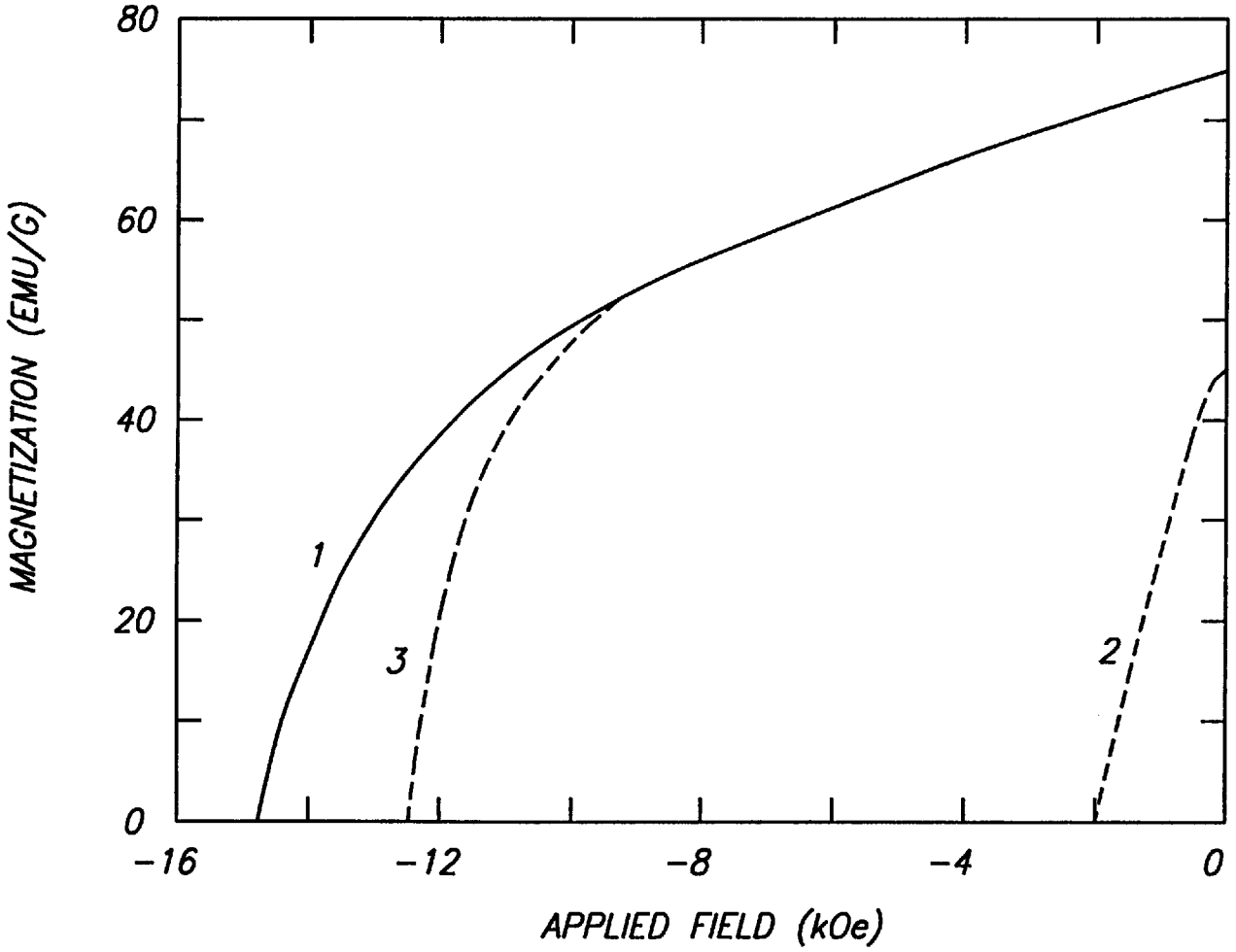
Figure 11:
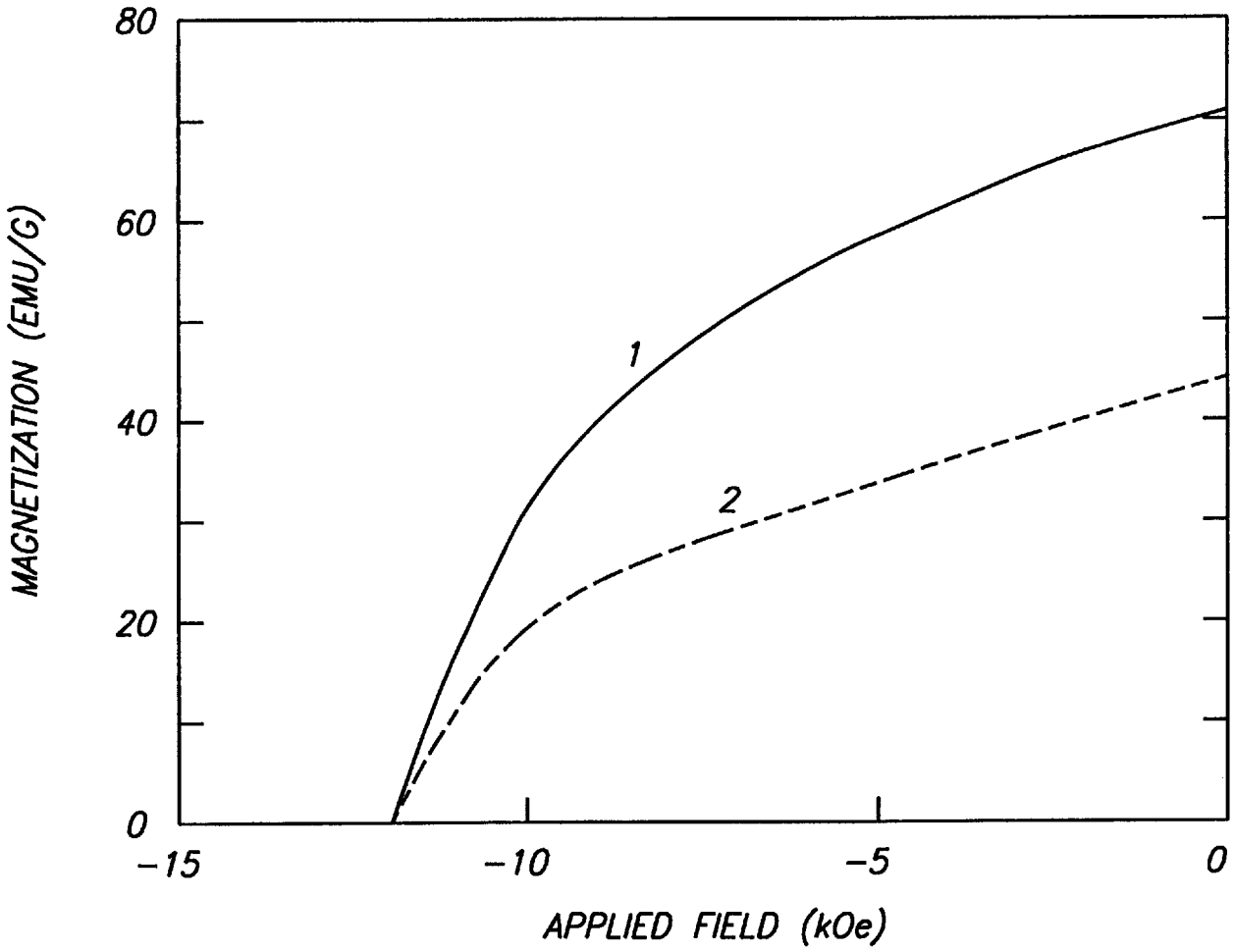
Figure 11:
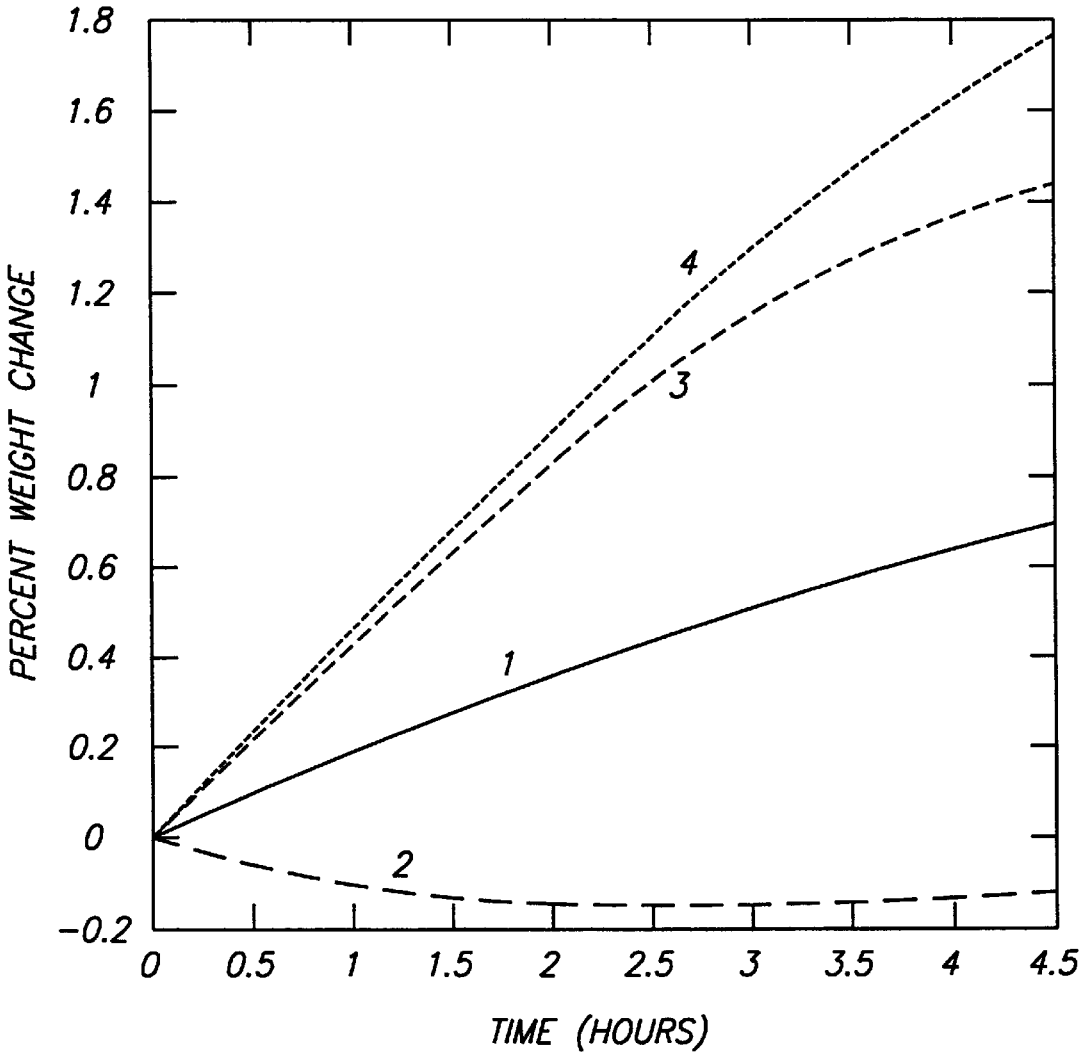

Referring to FIG. 11, thermogravimetric analysis curves are compared for (1) an alloy powder of the present invention comprising 67% Fe, 27% Nd, 2.2% Dy, 1.9% Ti, 0.7% C, and 1.17% B, by weight, which has been cooled by inert gas atomization and not been heat treated; (2) an alloy powder of the present invention comprising 67% Fe, 27% Nd, 2.2% Dy, 1.9% Ti, 0.7% C, and 1.17% B, by weight, which has been cooled by inert gas atomization and has also been heat treated at 800° C. for 10 minutes; (3) an alloy powder of the prior art comprising 63.9% Fe, 31.9% Nd, 3.1% Dy, and 1.13% B, by weight, which has been cooled by inert gas atomization and not been heat treated; and (4) an alloy powder of the prior art comprising 63.9% Fe, 31.9% Nd, 3.1% Dy, and 1.13% B, by weight, which has cooled by inert gas atomization and has also been heat treated at 650° C. for 10 minutes. The curves indicate the percent weight change of alloy powders held in flowing air at 225° C. for varying lengths of time.

The prior art alloy powder (curves 3 and 4) exhibits large weight gains over time. Such large weight gains are consistent with oxygen pickup and degradation (corrosion) of the material. In contrast, the alloy powder of the present invention (curves 1 and 2) has better corrosion resistance as indicated by a much lower weight gain. Note that the heat-treated sample of the alloy of the present invention (curve 2) is improved over the as-atomized sample (curve 1), whereas the heat-treated sample of the prior art alloy composition (curve 4) has worse properties than the as-atomized material of the prior art (curve 3). The heat-treated sample of the alloy of the present invention (curve 2) exhibits behavior similar to what would be obtained from a commercial alloy cooled by melt-spinning.

The results shown in FIG. 11 are particularly important for forming shaped magnets from alloy powders. Alloy powders having low corrosion resistance will be significantly degraded during the heating and other processing utilized in shaping magnets. On the other hand, alloy powders, such as those of the present invention, which can withstand relatively high temperature processing conditions can be more readily shaped into magnets.

Figure 12:
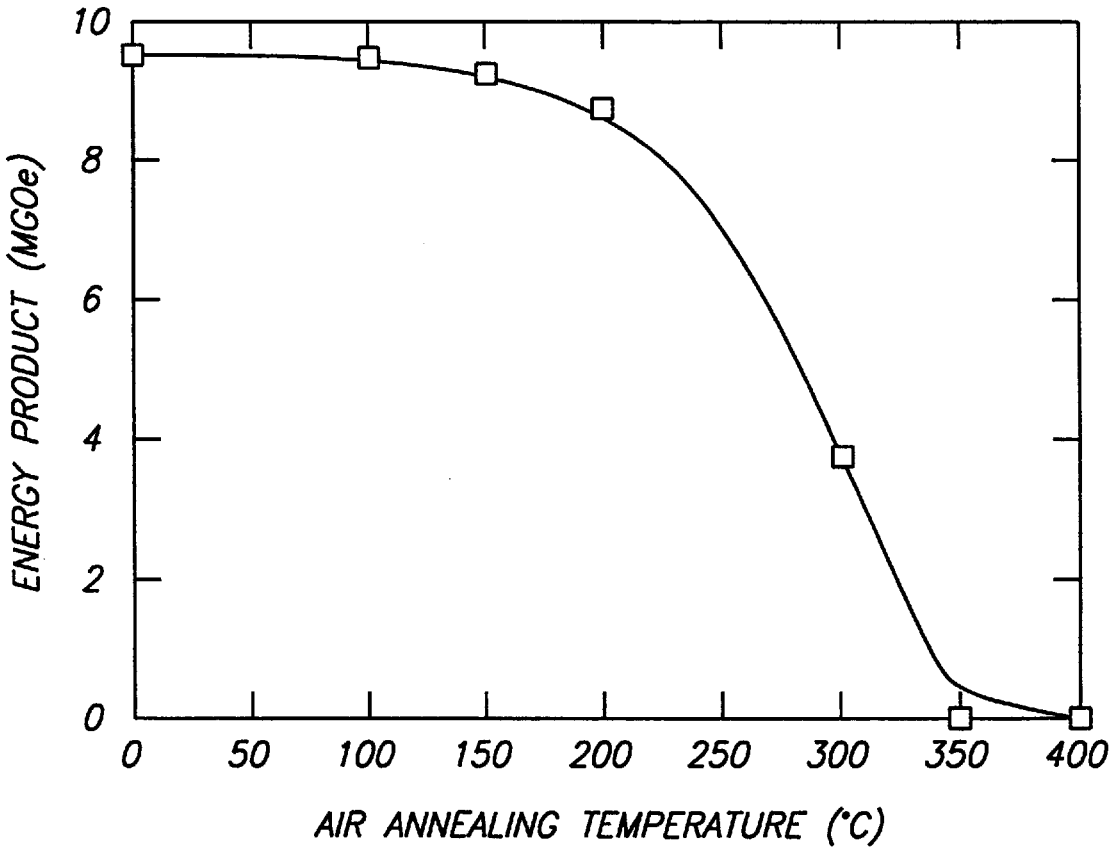
FIG. 12 is a graph of energy product (MGOe) versus air annealing temperature (° C.) for an alloy powder of the present invention.

Referring to FIG. 12, the air stability of an alloy powder of the present invention comprising 67% Fe, 27% Nd, 2.2% Dy, 1.9% Ti, 0.7% C, and 1.17% B, by weight, which has cooled by inert gas atomization and been heat treated at 800° C. for 10 minutes is illustrated. The data illustrated in FIG. 12 was obtained by subjecting samples of the alloy powder of the present invention to various temperatures for times of about one hour. As shown, significant losses in magnetic properties occurred only above temperatures greater than about 200° C. As most commercial bonding cycles utilize temperatures of about 175° C. for time periods of about ten minutes, the product of the present invention should be able to be utilized in such commercial bonding cycles. This is a significant advantage over previous materials formed by inert gas atomization processes, which typically significantly corroded or otherwise degraded when exposed to temperatures of 150° or more in air for very short times, such as, for example, times of about 5 minutes.

The present invention further encompasses a method of simulating atomization conditions. Specifically, it is recognized that a melt-spin process may be utilized to simulate gas atomization conditions. This is unexpected as melt-spin processes form significantly different products than do gas atomization processes. The product of a melt-spin process is a thin glitter-like particle which is cooled by falling onto a rapidly spinning wheel and collapsing into a flake shape. As the melt-spin-produced particle has a long thin shape, the particle cools generally non-uniformly through the various surfaces. In contrast, particles formed by atomization processes are generally spherical and cool in a generally spherical configuration. Accordingly, the atomization-produced particles cool generally uniformly through their thickness.

Surprisingly, in spite of the different mechanisms of cooling, it has been found that a tangential wheel speed of about ten meters per second in a melt-spinning process will reasonably accurately simulate the conditions of a gas atomization process. Accordingly, a gas atomization process may be simulated as follows.

Initially, a prototype melt is formed and cooled by ejecting the prototype melt onto a chill wheel having a surface tangential wheel speed of about nine meters per second. As the prototype melt cools, it forms a prototype cooled melt having physical properties which approximate physical properties that would have been obtained had the prototype melt been cooled by gas atomization conditions.

Next, the physical properties of the prototype cooled melt are analyzed and used to estimate physical properties that would have been obtained had the prototype melt been cooled by an gas atomization process.

The above-described simulation method has significant advantages for those interested in producing gas atomization conditions, such as, for example, those interested in producing new alloy compositions. For instance, gas atomization processes are typically significantly more expensive to run, even on a bench scale, than are melt-spin processes. Thus, the method of the present invention enables a person to relatively inexpensively test new alloy compositions for their utility in gas atomization processes.

In preferred embodiments of the invention, the chill wheel will comprise copper, and will be maintained at about room temperature. Also, in preferred embodiments of the invention the approximated physical properties will comprise magnetic coercivity, remnant magnetization, and/or energy product. The prototype melt can comprise any melt which could ultimately be used in an gas atomization process. For instance, the melt can comprise a rare earth element, a transition element and boron. Specifically, the prototype melt can comprise Nd, Fe and B.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

We claim:

1. An atomization method for forming a magnet powder comprising:

forming a melt comprising $R_{21}Q_{13.9}B_1$, Z and X, wherein R is a rare earth element; X is oxygen; Q is an element selected from the group consisting of Fe, Co and mixtures thereof; and Z is an element selected from the group consisting of Ti, Zr, Hf and mixtures thereof;

atomizing the melt, the atomizing including forming an atomized melt and cooling the atomized melt at a rate of less than or equal to about 100,000° C./second to form generally spherical alloy powder granules having an internal structure comprising at least one of a substantially amorphous phase or a substantially nanocrystalline phase; and heat treating the alloy to increase the energy product of the alloy powder; after the heat treatment, the alloy possessing an energy product of at least about 10 MGOe.

2. The method of claim 1 further comprising:

after heat treating the alloy powder, forming the alloy powder into a magnet.

3. An atomization method for forming a magnet powder comprising:

forming a melt comprising $Nd_{2.1}Fe_{13.9}B_1$, Ti and X, wherein X is oxygen, wherein the weight percentage of the combination of Ti and X is from about 0.1% to about 15%, and wherein the Ti and X are present in substantially equal molar amounts;

atomizing the melt, the atomizing including forming an atomized melt and cooling the atomized melt at a rate of less than or equal to about 100,000° C./second to form generally spherical alloy powder granules having an internal structure comprising at least one of a substantially amorphous phase or a substantially nanocrystalline phase; and heat treating the alloy powder to increase an energy product of the alloy powder.

4. The method for forming a magnet powder of claim 3 wherein, after the heat treatment, the energy product possessed by the alloy powder is greater or equal to about 10 MGOe.

5. A method for forming a magnet powder comprising:

forming a melt comprising Nd, Q, B, Z, and X wherein X is oxygen; Q is an element selected from the group consisting of Fe, Co, and mixtures thereof; and Z is an element selected from the group consisting of Ti, Zr, Hf and mixtures thereof;

atomizing the melt, the atomizing including forming an atomized melt and cooling the atomized melt at a rate of less than or equal to about 100,000° C./second to form alloy powder granules having an internal structure comprising at least one of a substantially amorphous phase or a substantially nanocrystalline phase, the internal structure having a weight percentage of elements selected from the group consisting of iron, cobalt, and mixtures thereof of at least 60%; and heat treating the alloy powder to increase the energy product of the alloy powder; after the heat treatment, the alloy powder possessing an energy product of at least about 10 MGOe.

6. The method for forming a magnet powder of claim 5 wherein the melt comprises a weight percentage of the combination of Z and X of from about 0.1% to about 15%.

7. The method for forming a magnet powder of claim 5 wherein the alloy powder granules are generally spherical and are from about 10 micrometers to about 300 micrometers in diameter.

* * * * *